US005693208A

United States Patent [19]

Paulet

[11] Patent Number: 5,693,208

[45] Date of Patent: Dec. 2, 1997

[54] PROCESS FOR CONTINUOUSLY ANODIZING STRIPS OR WIRES OF ALUMINUM

[75] Inventor: Jean-François Paulet, Siblingen, Switzerland

[73] Assignee: Alusuisse Technology & Management Ltd., Switzerland

[21] Appl. No.: 599,360

[22] Filed: Mar. 5, 1996

[30] Foreign Application Priority Data

Mar. 16, 1995 [CH] Switzerland ..... 00749/95

[51] Int. Cl.[6] ..... C25D 7/06; C25D 5/48; C25D 9/02; C25D 11/04

[52] U.S. Cl. ..... 205/139; 205/153; 205/229; 205/318; 205/319; 205/324; 205/328

[58] Field of Search ..... 205/139, 153, 205/229, 318, 319, 324, 328, 106, 108

[56] References Cited

U.S. PATENT DOCUMENTS

| | | | |
|---|---|---|---|
| 1,771,910 | 7/1930 | Bengough et al. | 205/213 |
| 3,020,219 | 2/1962 | Franklin et al. | 204/58 |
| 4,566,952 | 1/1986 | Sprintschnik et al. | 205/328 |
| 5,078,845 | 1/1992 | Kunugihara et al. | 205/153 |
| 5,566,952 | 1/1986 | Sprintschnik et al. | 205/328 |

FOREIGN PATENT DOCUMENTS

| | | |
|---|---|---|
| 7905911 | 6/1980 | Brazil . |
| 1486833 | 7/1966 | France . |
| 235 081 | 4/1986 | Germany . |
| 50-3254 | 2/1975 | Japan . |
| 8600207 | 8/1987 | Netherlands . |
| 387437 | 2/1933 | United Kingdom . |
| 1185346 | 3/1970 | United Kingdom . |

*Primary Examiner*—Kathryn L. Gorgos
*Assistant Examiner*—Edna Wong
*Attorney, Agent, or Firm*—Bachman & LaPointe, P.C.

[57] ABSTRACT

A process for producing an oxide layer with a pore structure on the surface of a strip or wire of aluminum or an aluminum alloy is such that the strip or wire is passed continuously through an electrolyte and simultaneously anodized under conditions that create pores and at an anodizing voltage creating the desired thickness of oxide layer. In a first stage of the process, in order to form a fine pore structure, the anodizing voltage is set at an initial level ($U_1$) and subsequently, in a second stage to form a coarser pore structure, raised to a final level ($U_2$) required to reach the desired thickness of oxide layer.

14 Claims, 4 Drawing Sheets

PROCESS FOR CONTINUOUSLY ANODIZING STRIPS OR WIRES OF ALUMINUM

BACKGROUND OF THE INVENTION

The invention relates to a process for producing an oxide layer with a pore structure on the surface of a strip or wire of aluminum or an aluminum alloy by passing the strip or wire continuously through an electrolyte and simultaneously anodizing the same under conditions that create pores at an anodizing voltage creating the desired thickness of oxide layer.

In preparing an aluminum surface for subsequent coating or adhesive bonding it is known to subject aluminum strips to continuous anodic oxidation i.e. anodizing in an acidic electrolyte. Provided the process parameters are strictly controlled, this form of pre-treatment enables an oxide layer to be formed with a particular pore structure that ensures bonding and durability of a subsequently deposited coating or adhesive layer.

Processes of the kind mentioned above are e.g. described in U.S. Pat. No. 3,714,001, U.S. Pat. No. 1,771,910, German Patent 2705651 and European Patent 0181173. These known processes enable oxide layers of conventional pore structure to be formed, whereby, with all these processes the dependence of the thickness of the oxide layer on the pore structure should be noted. The explanation for this lies in the two inherent and competitive processes involved viz., the creation and re-solution of the oxide layer. For example, anodic oxidation in phosphoric acid depends initially on the voltage for anodizing and also on the re-solution of the oxide layer.; The following ratios, explained with the aid of FIG. 1, are known from "The Surface Treatment and Finishing of Aluminum and its Alloys", 5th Edition, Vol. 1, Page 343:

Thickness of the barrier layer: 10.4 Å/V
Cell diameter A: 27.7 Å/V
Cell wall thickness B: 7.4 Å/V
Pore diameter C: 12.9 Å/V
Distance between pores D: 14.8 Å/V According to this a fine pore structure is possible if a low voltage is employed—which influences the ratio of the rate of growth ($G_1$) to the rate of re-solution ($G_2$) in such a manner that the limit to growth is reached quickly. It should be mentioned here that in the known processes for continuous anodizing the ratio $G_1$ to $G_2$ required to ensure sufficient pore widening as a result of resolution of the oxide layer is approximately 1. As the effective duration of anodizing in a continuous anodizing process is normally very short and cannot be extended at will without suffering a considerable loss in production or changing the production equipment, the result is that when producing a fine pore structure there is inevitably a thin oxide layer with the known disadvantages of low corrosion resistance of coated aluminum strips and increased susceptibility to filiform corrosion.

Thicker oxide layers can be produced in a short time only by applying higher voltages. Analogous to the above described concerning the production of fine pore structures, higher voltages lead to a coarser pore structure. As the pore distance D increases and pore widening is limited, so also is the formation of additional anchoring points at the nodal points of three neighboring cells (see FIG. 2 in connection with FIG. 1). A coarse pore structure has been found to be a disadvantage especially for adhesive systems of high viscosity such as e.g. adhesive films. In spite of the wider pores the adhesive does not penetrate the pores i.e. the anchoring takes place immediately at the surface of the oxide layer. For such adhesive systems a coarse pore structure is not suitable, as only oxide layers with fine pore structure offer the adhesive a significantly larger number of anchoring points.

Using the processes known to date, it is not possible to produce thicker layers with a fine pore structure continuously by anodising in an electrolyte containing phosphoric acid.

SUMMARY OF THE INVENTION

In view of the above the object of the present invention is to provide a process of the kind discussed above by means of which the thickness of the oxide layer can be chosen freely independent of the desired surface topography.

The objective of the invention is achieved in that in a first stage, in order to form a fine pore structure, the anodizing voltage is set at an initial level and subsequently, in a second stage to form a coarser pore structure, raised to a final level required to reach the desired thickness of oxide layer, the first voltage level for anodizing amounting to 25 to 75% of the final value.

Special and further developed versions of the process according to the invention are presented in the following specification.

According to the invention the anodizing process is carried out in two stages:

Stage 1: Forming a fine pore structure by anodizing at a low voltage level e.g. 25V/3 s.

Stage 2: Continuing the anodizing process at an elevated voltage level of e.g. 50V/3 s.

During stage 2 a reorganization of the pore structure takes place, in the jargon used in the field, pore joining or pore uniting. The pore structure formed during stage 2 is coarser than the pore structure formed in stage 1. The increased rate of formation as a result of the higher applied voltage ensures the further growth of the oxide layer. At the same time the pores of the upper fine structured layer are widened by resolution. Because of the small size of the pores, the widening of the pores can take place until neighboring pores meet, in the process forming claw like peaks in the surface of the oxide layer.

The first voltage level employed preferably lies at about 50% of the final anodizing voltage.

In order to insure as progressive reorganization of the pores as is possible, the increase in the anodizing voltage from the initial value to the final value is usefully relatively slow, preferably within 2 to 3 seconds. A sudden increase in voltage is not recommended as sudden reorganizing of the pore structure could lead to embrittling of the oxide layer, which means that later delamination of coated or adhesively bonded strips may occur. Basically it is also feasible for the anodizing voltage, when it reaches the initial level, to be increased to the final value without allowing any holding time at the initial level.

The anodizing voltage is preferably maintained at the final level at least until the oxide formation and resolution rates are equal, whereby for a given rate of passage of the strip or wire through the electrolyte, the composition of the electrolyte and the anodizing voltage are usefully selected or set such that the equilibrium between formation and resolution of the oxide layer is reached at a layer thickness of about 250 to 1500 nm. The treatment time necessary for this lies preferably between approximately 4 and 30 seconds.

The duration at the final anodizing voltage level is preferably about 25 to 75%, especially 50% of the overall treatment time.

In order to achieve a production rate that is as fast as possible, the anodizing is carried out using direct current, a suitable electrolyte containing phosphoric acid and/or sulphuric acid. The oxide layer according to the invention may subsequently be treated by impregnating it with corrosion inhibitors, in particular chromates, phosphates or cerium salts. Likewise, the oxide layer may be impregnated with hydration inhibitors, in particular phosphates or phosphoric acid derivatives.

BRIEF DESCRIPTION OF THE DRAWINGS

Further advantages, features and details of the invention are revealed in the following description of a preferred exemplified embodiment and with the aid of the drawings showing in.

DETAILED DESCRIPTION OF PREFERRED EMBODIMENTS

Figure 1:
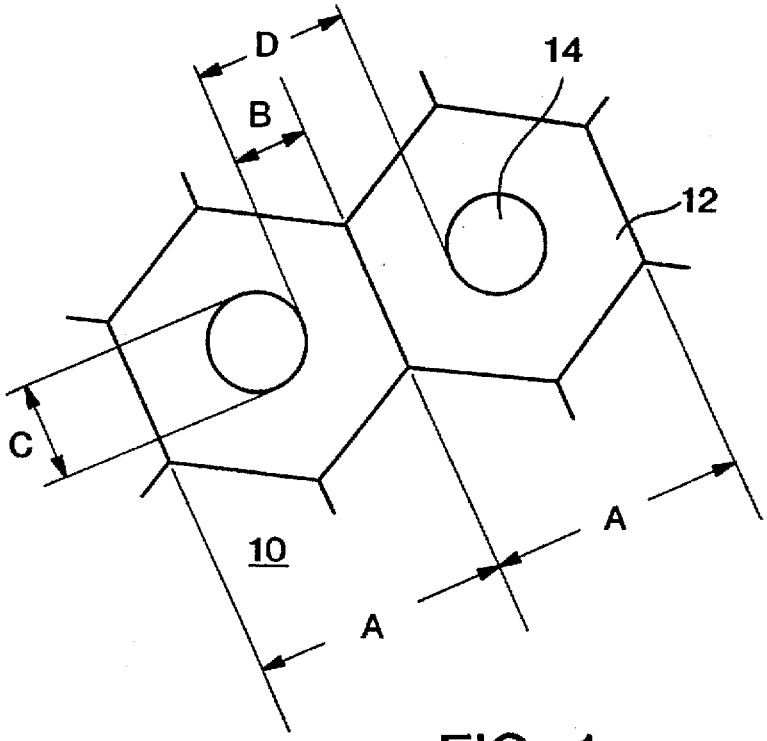
FIG. 1 a schematic cross-section through two neighboring cells of an oxide layer.
Figure 2A:
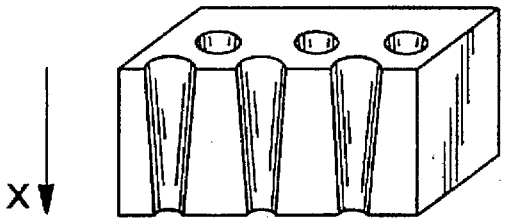
FIG. 2 a schematic representation of the various stages of formation and resolution of an anodic oxide layer.
Figure 2B:
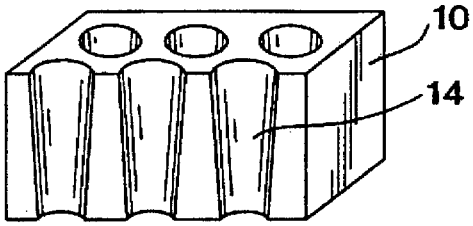
Figure 2C:
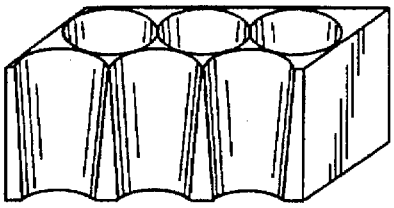
Figure 2D:
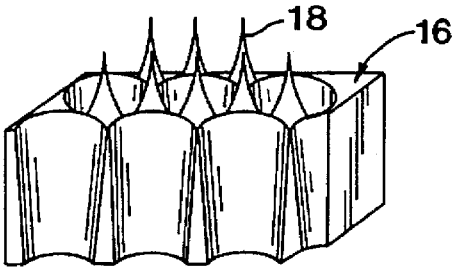

Shown in FIG. 1 are two neighboring cells 12 of an oxide layer 10. At the center of each cell 12 is a pore 14. The characteristic dimensions shown mean the following:

A: diameter of the cell 12
B: thickness of the wall of the cell 12
C: diameter of the pores 14
D: distance between neighboring pores 14

FIG. 2 shows various stages of an oxide layer 10 during resolution. Conical widening of the pores 14 takes place in the direction counter to the direction of growth x of the oxide layer. At the nodal point of three neighboring cells this, together with the resolution at the surface 16 of the oxide layer 10, leads to pyramid shaped or claw like projections 18 that later form anchoring points for an adhesive or coating deposited on the surface.

Figure 3:
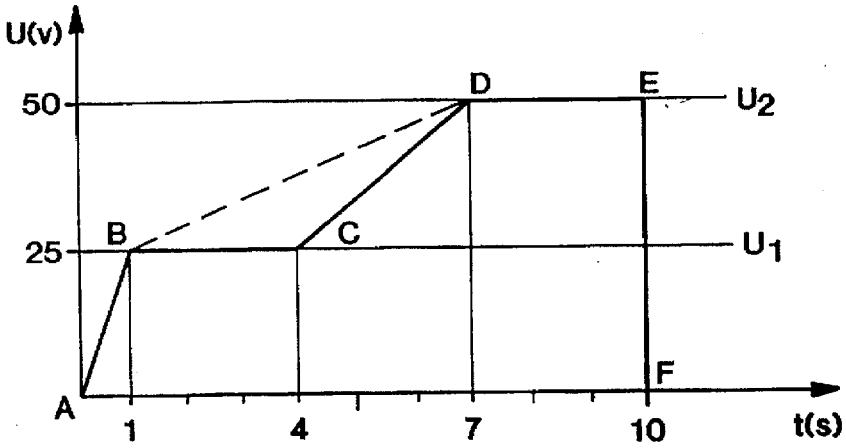
FIG. 3 an example of the variation in the voltage applied during anodizing.
Figure 4:
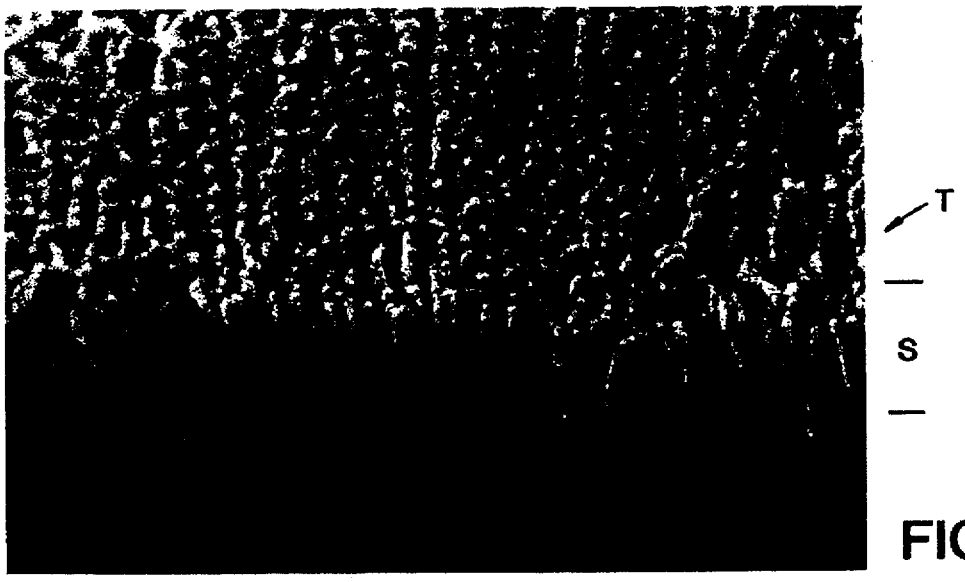
FIG. 4 a scanning-electron-microscope (SEM) image of the fracture surface of an oxide layer produced by the process according to the invention (magnification 50,000×)
Figure 5:
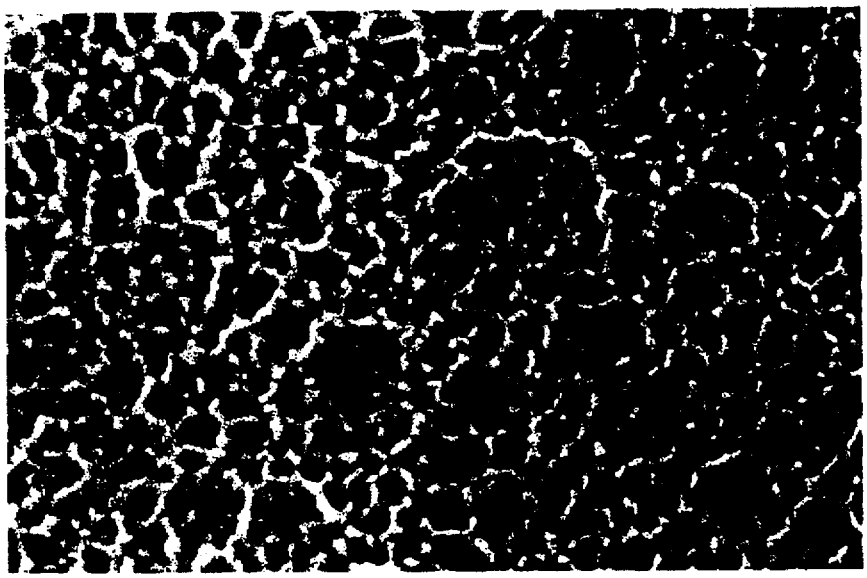
FIG. 5 an SEM image of an oxide layer produced by the process according to the invention (magnification 50,000×)

FIG. 3 shows the change in anodizing voltage as a function of time during the process according to the invention. Initially there is a rapid increase (AB) in the voltage, within one second, until the first level of 25 V is reached. The voltage of 25 V is held constant for 3 seconds (BC), subsequently increased within 3 seconds to a level of 50 V (CD), then held constant at this level for 3 seconds(DE). After an overall treatment time of 10 seconds the voltage drops rapidly (EF). Instead of a pronounced first holding stage (BC) the anodizing voltage may also be increased continuously from the first to the second level (BD). The length of the second treatment stage (DE) depends on the thickness of oxide layer desired and on the claw like peak like structure. Normally, the desired thickness of oxide has been formed after approximately 3 seconds. Of course there are many possibilities for creating the change in voltage shown. The simplest way of achieving this is by an appropriate supply of current or by the geometry of the anodizing cells and the cathodes. The appearance of the oxide layer produced according to the invention can be seen clearly in FIGS. 4 and 5. The lower side of the oxide layer S facing the aluminum strip shows a coarse pore structure, whereas the upper layer T facing the electrolyte exhibits a fine pore structure. The very fine pore structure with a large number of claw like peaks can be seen in FIG. 5.

The following examples show how advantageous the process according to the invention is.

EXAMPLE 1

(State of the Art)

Figure 6:
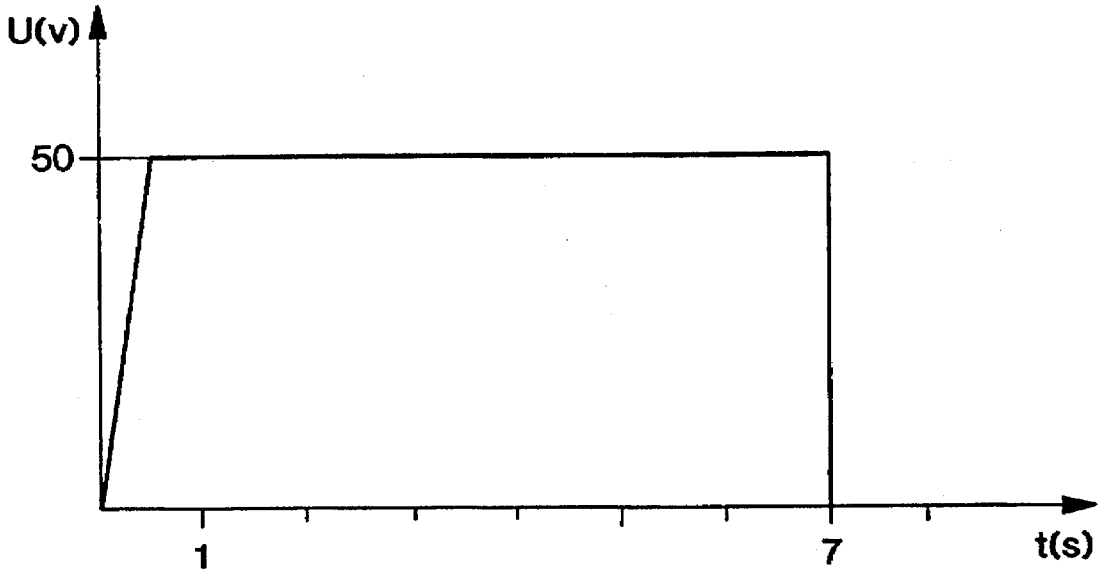
FIG. 6 the change in anodising voltage as a function of time during production of an oxide layer using a state-of-the-art process.

An oxide layer was produced continuously on an aluminum strip using the voltage sequence shown in FIG. 6 under the following conditions:

Electrolyte: $H_3PO_4$/150 g/l/65° C.
Strip speed: 30 m/min

Figure 7:
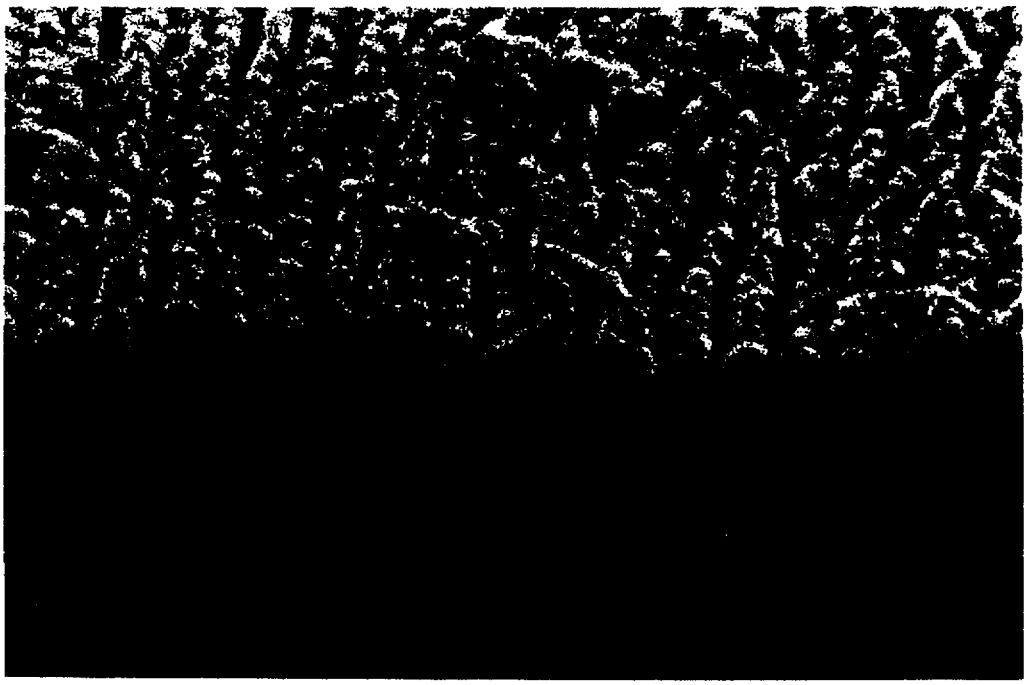
FIG. 7 an SEM image of the fracture surface of an oxide layer produced using the change in anodizing voltage according to FIG. 6.

FIG. 7 shows the coarse pore structure produced using the state of the art process.

EXAMPLE 2

(According to the Invention)

Figure 8:
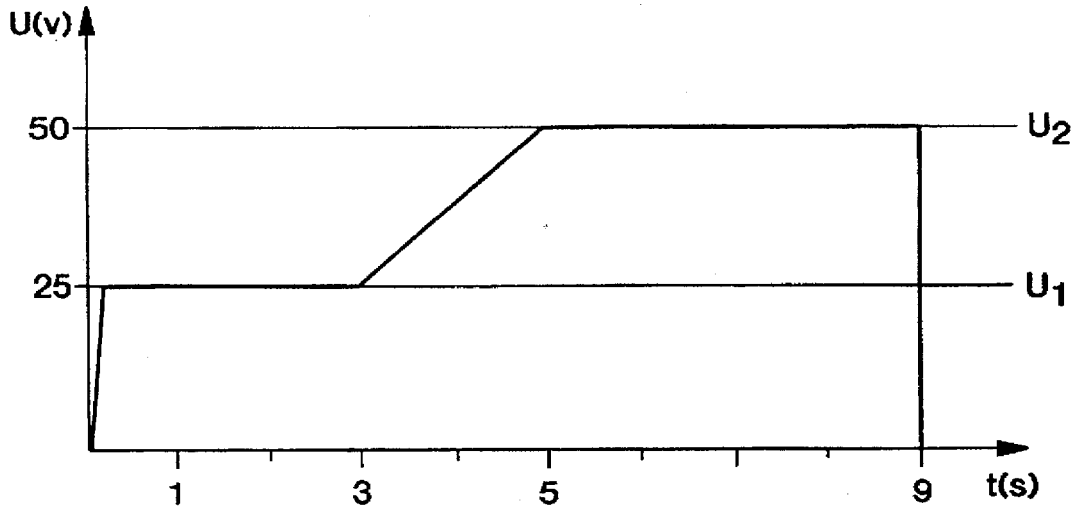
FIG. 8 the change in anodizing voltage as a function of time during production of an oxide layer using the process according to the invention.

An oxide layer was produced continuously on an aluminum strip using the voltage sequence shown in FIG. 8 under the same conditions as in the first example.

Figure 9:
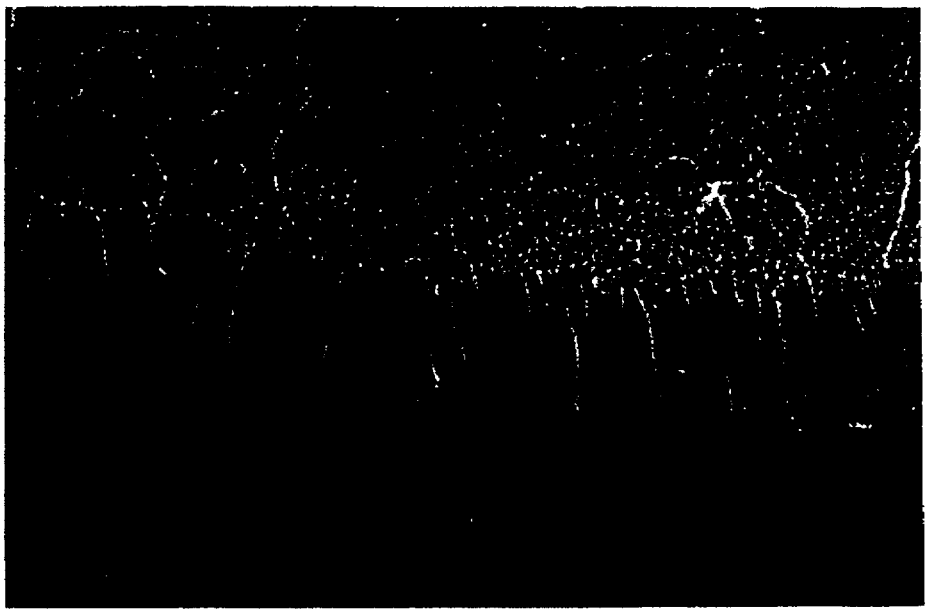
FIG. 9 an SEM image of the fracture surface of an oxide layer produced using the change in anodising voltage as a function of time shown in FIG. 8

FIG. 9 shows clearly a lower layer with a coarse pore structure and an upper layer with a fine pore structure.

EXAMPLE 3

An aluminum/polyethylene/aluminum laminate was manufactured using the strips produced in examples 1 and 2 and the bond strength between the aluminum outer layer and the polyethylene core was determined according to ASTM 1781 prior to and after a 1000 hour acetic acid -salt-spray test according to DIN 50021 ESS. The results are summarized in the following table:

| | Bond strength Nmm/mm | | |
|---|---|---|---|
| Laminate | Initial value | After 1000 h ESS | Appearance of fracture |
| A | 120 | 125 | 100% adhesion |
| B | 413 | 394 | 50% adhesion<br>50% cohesion |

A manufactured using the Al strip from example No. 1
B manufactured using the Al strip from example No. 2

The results clearly show the advantages of the oxide layer produced by the process according to the invention.

I claim:

1. Process for producing an oxide layer with a pore structure having projections on the surface of a strip or wire of aluminum or an aluminum alloy, which comprises passing the strip or wire continuously through an electrolyte and simultaneously anodizing the same under conditions that create pores at an anodizing voltage creating the desired thickness of the oxide layer, wherein in a first stage, in order to form a fine pore structure, the anodizing voltage is raised to a constant first voltage level ($U_1$) and subsequently, in a second stage to form a coarser pore structure, raised to a final level ($U_2$) required to reach the desired thickness of the oxide layer and maintained at the final level ($U_2$) at least until the rates of formation of oxide growth and oxide re-solution are equal, the first voltage level ($U_1$) for anodizing amounting to 25 to 75% of the final level ($U_2$) wherein the oxide layer produced has the pore structure and the projections on the surface.

2. Process according to claim 1, wherein the first voltage level ($U_1$) for anodizing amounting to about 50% of the final value ($U_2$).

3. Process according to claim 1, wherein the anodizing voltage is slowly increased from the first level ($U_1$) to the final level ($U_2$).

4. Process according to claim 3, wherein the anodizing voltage is increased from the first level ($U_1$) to the final level ($U_2$) within 2 to 3 seconds.

5. Process according to claim 3, wherein the voltage is increased to reach the first level and is increased from the first level to the final level, and wherein the rate of increase to reach the final level is slower than the rate of increase to reach the first level.

6. Process according to claim 1, wherein at a given rate of passage of the strip or wire through the electrolyte, the composition and temperature of the electrolyte and the anodizing voltage are set such that the equilibrium between formation and re-solution of the oxide layer is reached at a layer thickness of 250 to 1500 nm.

7. Process according to claim 6, wherein the equilibrium between formation and re-solution of the oxide layer is reached after a treatment time of 4 to 30 seconds.

8. Process according to claim 7, wherein the duration of time at the final voltage level ($U_2$) represents 25 to 75% of the overall duration of treatment.

9. Process according to claim 1, wherein the anodizing process is carried out with direct current.

10. Process according to claim 1, wherein the electrolyte contains at least one of phosphoric acid and sulphuric acid.

11. Process according to claim 1, wherein the oxide layer is subsequently treated by impregnation with corrosion inhibitors.

12. Process according to claim 11, wherein the oxide layer is subsequently treated by impregnation with one of chromates, phosphates and cerium salts.

13. Process according to claim 1, wherein the oxide layer is subsequently treated by impregnation with hydration inhibitors.

14. Process according to claim 13, wherein the oxide layer is subsequently treated by impregnation with one of phosphates and phosphoric acid derivatives.

* * * * *